US008528125B1

(12) United States Patent
McFadden

(10) Patent No.: US 8,528,125 B1
(45) Date of Patent: Sep. 10, 2013

(54) BASIN DEVICE FOR USE IN WASHING THE HAIR OF A PERSON SITTING UPRIGHT

(76) Inventor: Christopher P. McFadden, Philadelphia, PA (US)

( * ) Notice: Subject to any disclaimer, the term of this patent is extended or adjusted under 35 U.S.C. 154(b) by 1778 days.

(21) Appl. No.: 11/698,821

(22) Filed: Jan. 29, 2007

(51) Int. Cl.
*A45D 44/08* (2006.01)

(52) U.S. Cl.
USPC ..... 4/521; 4/520

(58) Field of Classification Search
USPC ..... 4/520–523
See application file for complete search history.

(56) References Cited

U.S. PATENT DOCUMENTS 1,438,099 A * 12/1922 De Velasco ..... 4/521
4,014,054 A 3/1977 Pasquarello ..... 4/159
4,216,551 A 8/1980 Pasquarello ..... 4/521
4,411,032 A * 10/1983 Lewy ..... 4/523
D375,385 S * 11/1996 Mock ..... D28/20
5,946,745 A 9/1999 Magee ..... 4/522
6,415,458 B1 7/2002 McFadden ..... 4/521

* cited by examiner

*Primary Examiner* — Gregory Huson
*Assistant Examiner* — Lauren Heitzer
(74) *Attorney, Agent, or Firm* — LaMorte & Associates, P.C.

(57) ABSTRACT

A portable washbasin assembly that is used to catch water when a person is having his/her hair washed. A basin is provided that rests on the shoulders of the person. This enables the person to have his/her hair washed while sitting upright or near upright. The basin has a bottom surface through which is disposed a generally centralized opening. An outer vertical wall extends around the periphery of the bottom surface. An inner vertical wall extends upwardly from the bottom surface around the centralized opening. A flexible membrane is stretched over the centralized opening between sections of the inner vertical wall. The flexible membrane contains a hole that is positioned over the below lying centralized opening.

12 Claims, 3 Drawing Sheets

BASIN DEVICE FOR USE IN WASHING THE HAIR OF A PERSON SITTING UPRIGHT

BACKGROUND OF THE INVENTION

1. Field of the Invention

The present invention relates generally to basins that are used to hold or catch water during the washing of a person's hair. In particular, the present invention relates to portable basins which permit the washing or shampooing of a person's hair while the person maintains an inclined or upright body position.

2. Prior Art Description

When the hair of a person is shampooed by another, the process is typically performed over a sink or bathtub. Professional hair salons typically perform the washing or shampooing of a person's hair over a contoured sink. To use a contoured sink, a person places his/her neck into a relief that is formed along the brim of the sink. Such positioning typically requires sharp backward bending of the person's neck. This is often inconvenient, uncomfortable, or impossible, particularly for hospital or nursing home patients with limited mobility. Additionally, such sharp bending of the neck results not only in discomfort due to increased pressure on the neck, but also in restriction of blood flow, which can lead to medical complications.

Recognizing that not all people are capable of having their hair washed over a sink. Devices have been invented that enable a person's hair to be washed while that person is sitting upright, or in a slightly inclined position. For example, U.S. Pat. No. 4,216,551 to Pasquarello, entitled Shampoo Apparatus, discloses a portable shampoo apparatus that is contoured to fit adjacent a person's neck and to facilitate the shampooing process. This device channels all water it receives to one point. Accordingly, as water flows down the head, it is immediately channeled away from the head. Consequently, the device must be used close to a sink that can receive the water. Having a sink close at hand is often impractical for bedridden people. Furthermore, since the device only channels water that falls from the back of the head, the system has a tendency to leak. This wets the clothing, linens and the bedding of the person having their hair washed. This is highly undesirable since it is extremely labor intensive to change the clothes, linens and bedding of a bedridden person.

U.S. Pat. No. 4,014,054 to Pasquarello, entitled Shampoo Device, discloses another shampoo device that partially fits around a person's neck. The device relies upon a belt-like closure for looping around the patient's neck to form a seal. The closure includes a tie string or the like to maintain the seal around the base of the patient's neck. However, this design causes water to flow toward the seal at the base of the patient's neck and collect, which creates a leakage problem. The seal around the neck cannot be made too tight for obvious blood flow and comfort reasons.

U.S. Pat. No. 5,946,745 to Magee, entitled Portable Shampoo Bowl, discloses a closed system which acts as a reservoir and does not require a patient to assume a position adjacent a sink. The Magee device is a complex multi-piece system which is coupled with a cape having a drawstring to facilitate a seal around the neck. The cape is fitted around the base of the neck beneath the device. The patient must keep constant tension on the drawstrings to prevent leakage. This is undesirable for unconscious patients or patients incapable of maintaining such constant tension, as leakage will result. Alternatively, more than one person would have to participate in the shampooing procedure to ensure that the patient's clothes remain dry, which is undesirable because of the time and costs associated with employing additional personnel to perform the shampooing procedure. Additionally, water is caused to flow toward the seal around the patient's neck and allowed to collect. This causes a leakage problem. This is ameliorated in part by the provision of a reservoir below the seal with the patient's neck. However, water in the reservoir makes the device heavy and unstable, which makes it difficult or impossible for patients to support and which increases the risk of water spillage due to instability of the reservoir.

Some of the problems associated with prior art hair washing basins have been addressed in U.S. Pat. No. 6,415,458 to McFadden, the inventor herein, entitled Shampooing Device. In the McFadden patent, a basin is described that seals to the body above the level of the water. Accordingly, the seal against the body produces little leakage. However, a strap is still used to make the seal. The use of a strap comes with the chance that the strap can be overtightened, therein causing restricted blood flow and/or discomfort to the person having their hair washed.

A need therefore exists for a basin that enables a person to have their hair washed while in an upright position that creates a watertight seal around the neck, yet does so without possibly restricting blood flow through the neck or causing discomfort. This need is met by the present invention as described and claimed below.

BRIEF DESCRIPTION OF THE DRAWINGS

For a better understanding of the present invention, reference is made to the following description of an exemplary embodiment thereof, considered in conjunction with the accompanying drawings, in which.

SUMMARY OF THE INVENTION

The present invention is a portable washbasin assembly that is used to catch water when a person is having his/her hair washed. A basin is provided that rests on the shoulders of the person. This enables the person to have his/her hair washed while sitting upright or near upright. The basin has a bottom surface through which is disposed a generally centralized opening. An outer vertical wall extends around the periphery of the bottom surface. An inner vertical wall extends upwardly from the bottom surface around the centralized opening.

A flexible membrane is stretched over the centralized opening between sections of the inner vertical wall. The flexible membrane contains a hole that is positioned over the below lying centralized opening.

To utilize the washbasin assembly, a person passes his/her head through the central opening in the basin and through the hole in the membrane. The membrane is highly elastic and creates a seal around the user's neck without constricting blood flow through the neck. The seal created by the flexible membrane is elevated well above the bottom of the basin. Accordingly, as water flows into the basin during a hair washing procedure, that water does not reach the flexible membrane. The seal created by the flexible membrane is therefore not prone to leak.

Water that collects within the basin flows into a drain and out a drain tube. The drain tube can lead to a sink, or to a bucket if a sink is not close at hand.

DETAILED DESCRIPTION OF THE DRAWINGS

Although the present invention washbasin assembly can be used to isolate different extremities of the body during washing, such as an arm or a leg, the present invention is particularly well suited for isolating a person's head during the washing of that person's hair. Accordingly, the present invention is illustrated and described in an application where it is used for hair washing. Such an exemplary embodiment is selected to present the best mode contemplated for the invention. It should be understood that the present invention washbasin assembly can also be applied to other parts of the body and to other objects that need to be selectively washed. All such alternate uses of the invention are intended to be included within the scope of the invention as defined by the claims.

Figure 1:
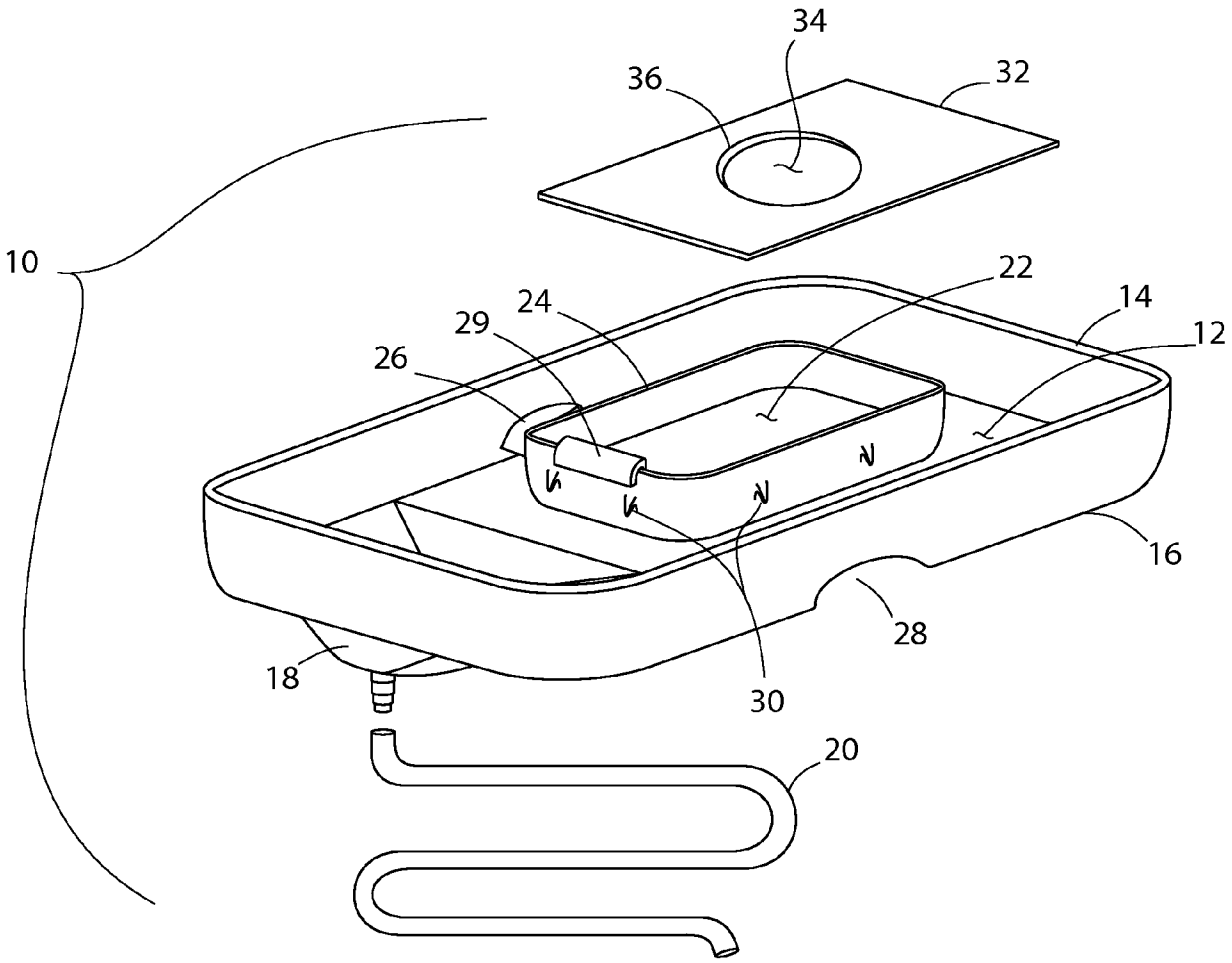
FIG. 1 is an exploded perspective view of an exemplary embodiment of the present invention.
Figure 2:
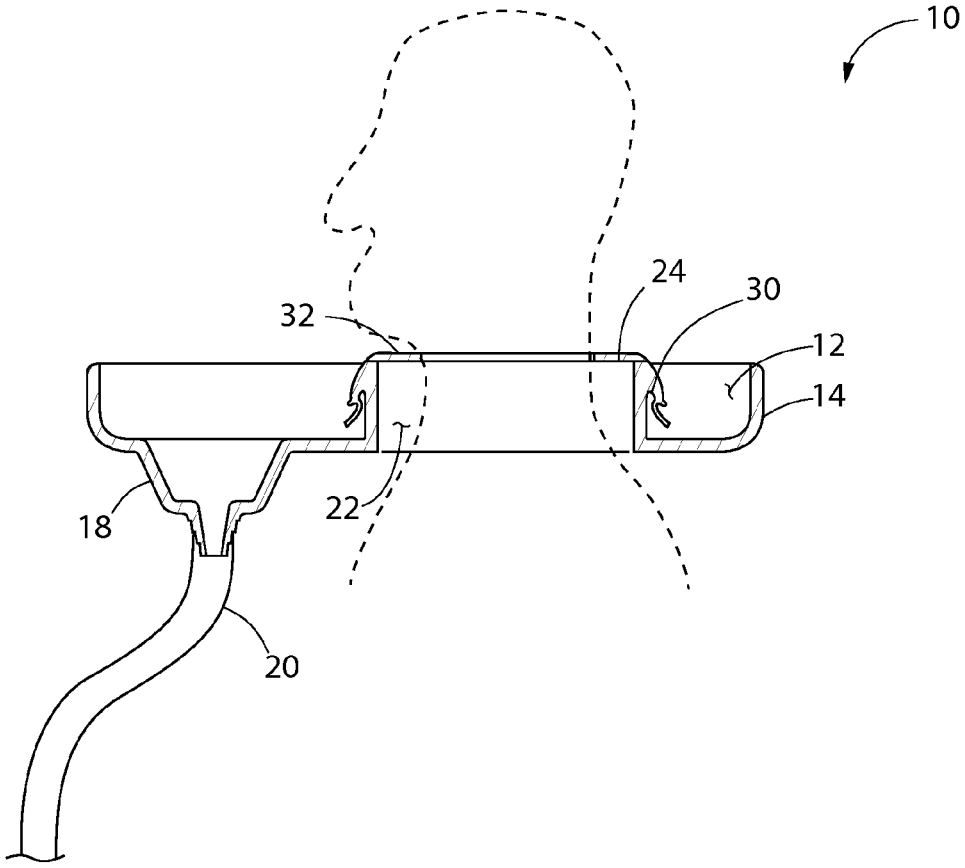
FIG. 2 is a cross-sectional view of the embodiment shown in FIG. 1.

Referring to both FIG. 1 and FIG. 2, there is shown an exemplary embodiment of a washbasin assembly 10. The washbasin assembly 10 has a primary reservoir 12 that is defined along its exterior by continuous peripheral walls 14. In the shown embodiment, the primary reservoir 12 has a rectangular shape. It should be understood that such a shape is merely exemplary and other shapes, such as round and square, can be used with equal effectiveness.

The primary reservoir 12 has a bottom surface 16 that spans between the peripheral walls 14. A funnel structure 18 is formed in the bottom surface 16. The funnel structure 18 collects all water that flows into the primary reservoir 12. A tube 20 is attached to the funnel structure 18. The tube 20 is used to channel away the water that flows into the funnel structure 18.

A head opening 22 is disposed in the primary reservoir 12 proximate its geometric center. The head opening 22 is fenced by continuous vertical walls 24 that extend upwardly from the bottom surface 16 of the primary reservoir 12. Accordingly, it will be understood that the primary reservoir 12 can hold water between the vertical walls 24 surrounding the head opening 22 and the outer peripheral walls 14.

Two bulges 26 are present in the bottom surface 16 of the primary reservoir 12 on opposite sides of the head opening 22. The bulges 26 are convex on the interior of the primary reservoir 12 and concave on the exterior. The bulges 26 create shoulder reliefs 28 that enable the washbasin assembly 10 to more steadily rest upon the shoulders of a person during a hair washing procedure.

Padding 29 may optionally be present on the top of the vertical walls 24 of the head opening 22. As will later be described in more detail, the padding 29 prevents the head opening 22 from injuring a person when the washbasin assembly 10 is being placed upon, or removed from, the head of a person.

Catch hooks 30 are present on the exterior of the vertical walls 24 of the head opening 22. The catch hooks 30 are oriented downwardly and are used to snag the edges of a flexible membrane 32. The flexible membrane 32 is stretched over the head opening 22. The flexible membrane 32 is kept taut over the head opening 22 by the engagement of the edges of the flexible membrane 32 by the various catch hooks 30. The flexible membrane 32 is not solid. Rather, the flexible membrane 32 defines a central hole 34 that is stretched open over the center of the head opening 22 as the flexible membrane 32 is stretched between the catch hooks 30. The central hole 34 is defined by a continuous open edge 36 that is cut into the flexible membrane 32.

The flexible membrane 32 is made of a soft, flexible, water impervious and highly elastic material. The preferred material is a styrene based tri-block copolymer gel material. Examples of tri-block copolymer gels include poly(styrene-ethylene-ethylene-propylene-styrene), polystyrene-ethylene-propylene-styrene) and poly(styrene-butylene-propylene-styrene) that are mixed with a plasticizing oil to achieve a desired durometer. Such material is extremely elastic, having the ability to stretch over ten fold without tearing and without permanent distortion.

Figure 3:
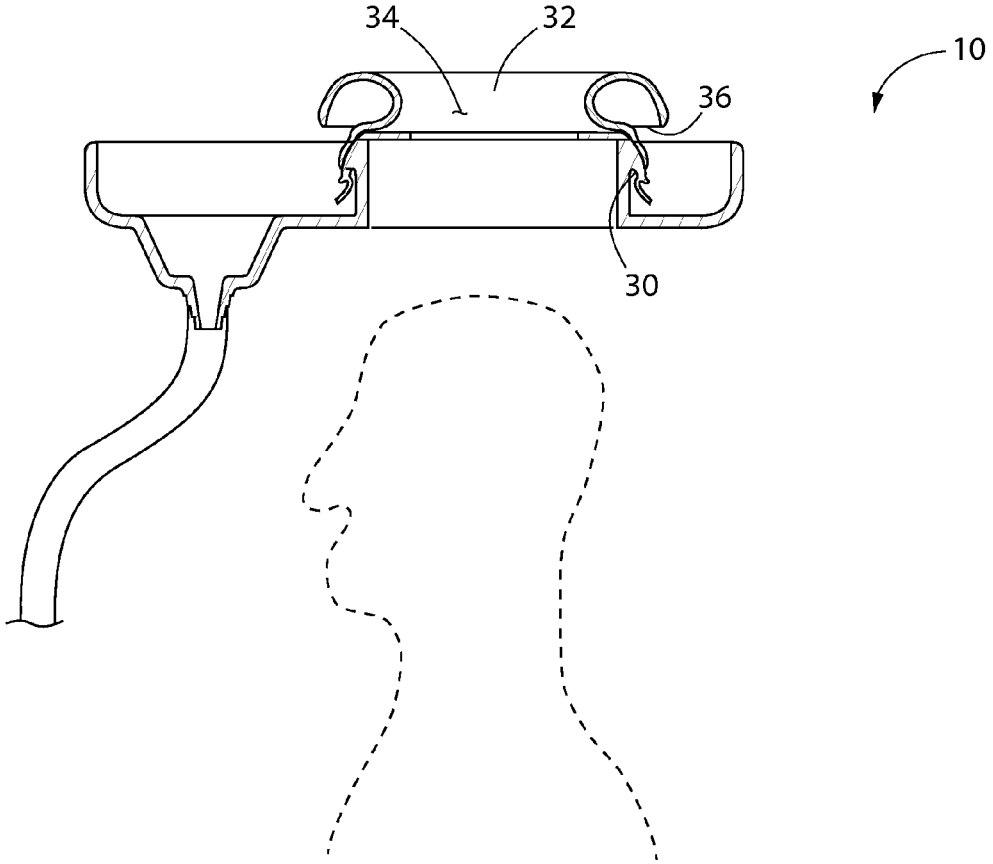
FIG. 3 is a cross-sectional view showing a temporary configuration used during the application of the invention onto a user's body.

Referring to FIG. 3 in conjunction with FIG. 2, a preferred method of use for the washbasin assembly 10 is described. Initially, the washbasin assembly 10 is configured to the condition expressed in FIG. 2, wherein the flexible membrane 32 is stretched over the head opening 22 and is engaged by the catch hooks 30. To prepare the washbasin device 10 for application onto a person, the central hole 34 of the flexible membrane 32 is temporarily stretched open. To stretch open the central hole 34 of the flexible membrane 32, the open edge 36 of the central hole 34 is stretched open until it can be set onto the catch hooks 30. Once the open edge 36 of the central hole 34 is engaged by the catch hooks 30, the central hole 34 is hyper-expanded to a size close to the size of the head opening 22. This enables the washbasin assembly 10 to be placed over a person's head without requiring the person to force their head through a small opening.

The washbasin assembly 10 is passed over a person's head with the central hole 34 of the flexible membrane 32 being temporarily held open. The washbasin assembly 10 is brought to rest on the person's shoulders. The person's shoulders pass into the shoulder reliefs 28 created by the bulges 26 in the bottom surface 16 of the washbasin assembly 10. In this manner, the washbasin assembly 10 will not teeter on the person's shoulders. Once the washbasin assembly 10 is comfortably resting on the shoulders, the open edge 36 of the central hole 34 is disconnected from the catch hooks 30.

Once detached from the catch hooks 30, the central hole 34 in the flexible membrane 32 attempts to contract back to its original size. However, a person's neck is now inside the opening defined by the central hole 34. Consequently, the flexible membrane 32 only contracts back until it contacts the person's neck. Once in contact with the person's neck, the extreme elasticity of the flexible membrane 32 prevents the flexible membrane 32 from squeezing the neck with any appreciable force. The flexible membrane 32, therefore, does not restrict blood flow through the neck or otherwise cause discomfort.

Water and shampoo are used to wash the person's hair in the traditional manner. As water runs down the head, the water collects in the primary basin 12. Water accumulating in the primary basin 12 flows into the funnel structure 18 and into the drain tube 20. The drain tube 20 leads the water to a sink, or to a bucket if a sink is not at hand.

The flexible membrane 32 creates a seal against the neck of the user. Furthermore, the area of the seal is elevated above the bottom surface 16 of the primary basin 12. Accordingly, any water drains into the funnel structure 18 well before it rises to the level of the flexible membrane 32. Since the seal created by the flexible membrane 32 is not exposed to any standing water, there is no significant leakage and the clothes, linens and bedding of the person remain dry during the hair washing procedure.

When the hair washing procedure is complete, the open edge 36 of the central hole 34 is again stretched out to engage the catch hooks 30. This expands the central hole 34 and causes the flexible membrane 32 to expand away from the person's neck. The washbasin assembly 10 can then be lifted over the person's head without the washbasin assembly 10 rubbing along the face and causing discomfort.

The embodiment of the present invention illustrated and described is merely exemplary. It will be understood that a person skilled in the art can make many variations to the shown embodiment using functionally equivalent components. For instance, the shape of the primary basin can be changed. Furthermore, many fastening devices, other than catch hooks, can be used to hold the flexible membrane onto the catch basin assembly. All such variations, modifications and alternate embodiments are intended to be included within the scope of the present invention as set forth by the claims.

What is claimed is:

1. A portable wash basin assembly, comprising:

a basin having a bottom surface through which is disposed a generally centralized opening;

an outer vertical wall extending upwardly around said bottom surface;

an inner vertical wall extending upwardly from said bottom surface around said centralized opening, said inner vertical wall having exterior surfaces that face said outer vertical wall;

a plurality of catch hooks disposed on said exterior surface of said inner vertical wall; and a flexible membrane of elastomeric gel having a hole disposed therethrough, said flexible membrane being stretched over said centralized opening and down said exterior surfaces of said inner vertical wall, wherein said flexible membrane is stretched to contact said plurality of catch hooks, wherein said plurality of catch hooks hook and engage said flexible membrane and hold said flexible membrane stretched over said centralized opening and positioning said hole over said centralized opening.

2. The assembly according to claim 1, wherein said flexible membrane is an elastomeric gel comprised of a styrene based copolymer mixed with plasticizing oil.

3. The assembly according to claim 1, wherein shoulder depressions are disposed in said bottom surface of said basin.

4. The assembly according to claim 1, further including a drain tube that provides drainage to said basin between said inner vertical wall and said outer vertical wall.

5. The assembly according to claim 4, wherein said bottom surface of said basin defines a funnel structure that leads into said drain tube.

6. A washbasin assembly comprising:

a basin that defines a central opening, wherein said central opening is surrounded by an inner wall that enables said basin to hold water without water flowing out through said central opening;

a plurality of catch hooks extending outwardly from said inner wall;

a flexible membrane having a hole formed therethrough, said flexible membrane being stretched over said central opening and down said inner wall to said plurality of catch hooks, wherein said catch hooks hook said flexible membrane and suspended said flexible membrane over said central opening so that said hole is said flexible membrane is centered above said central opening; and a drain for draining said basin.

7. The assembly according to claim 6, wherein said basin includes a peripheral outer wall, wherein said peripheral outer wall surrounds said inner wall.

8. The assembly according to claim 7, wherein said drain drains said basin between said inner wall and said peripheral outer wall.

9. The assembly according to claim 6, wherein said flexible membrane is an elastomeric gel comprised of a styrene-based copolymer mixed with plasticizing oil.

10. The assembly according to claim 6, further including shoulder depressions that are disposed in said basin.

11. The assembly according to claim 6, further including a drain tube that is coupled to said drain and provides drainage to said basin between said inner wall and said peripheral outer wall.

12. The assembly according to claim 11, wherein said basin defines a funnel structure that leads into said drain tube.

* * * * *